United States Patent [19]

Boyer et al.

[11] Patent Number: 4,862,786

[45] Date of Patent: Sep. 5, 1989

[54] FLUID CYLINDER CUSHIONING SYSTEM

[75] Inventors: Peter W. Boyer, Manteno; Roger W. Haczynski, Beecher, both of Ill.

[73] Assignee: Bimba Manufacturing Company, Monee, Ill.

[21] Appl. No.: 207,743

[22] Filed: Jun. 16, 1988

Related U.S. Application Data

[62] Division of Ser. No. 89,869, Aug. 27, 1987, Pat. No. 4,794,681.

[51] Int. Cl.[4] ..... F15B 15/22

[52] U.S. Cl. ..... 91/26; 91/396; 92/85 B; 277/207 R

[58] Field of Search ..... 91/443, 462, 463, 449, 91/395, 394, 396, 25, 26, 31; 92/85 R, 85 B; 417/511, 513; 277/207 R, 211; 285/917

[56] References Cited

U.S. PATENT DOCUMENTS

| | | | |
|---|---|---|---|
| 2,804,052 | 8/1957 | Halladay et al. | 91/26 |
| 2,853,974 | 9/1958 | Hewitt | 91/26 |
| 3,267,815 | 8/1966 | Ortman et al. | 91/396 X |
| 3,303,746 | 2/1967 | Schmoeger | 91/26 |
| 3,440,930 | 4/1969 | Olson | 92/85 X |
| 3,805,672 | 4/1974 | Pekrul | 92/85 B |
| 4,296,675 | 10/1981 | Gies | 91/26 X |
| 4,301,714 | 11/1981 | Stenlund et al. | 91/26 X |
| 4,458,717 | 7/1984 | Boland | 91/26 X |

*Primary Examiner*—Edward K. Look

*Attorney, Agent, or Firm*—Lockwood, Alex, Fitzgibbon & Cummings

[57] ABSTRACT

A cushioning system for a fluid power cylinder includes a first passage for the flow of fluid to and from the space between the piston and end cap closure of the cylinder, and a second passage including a throttling valve for throttling the flow of fluid from the space as the piston approaches the end cap closure to cushion the piston. An O-ring seal is centered in the first passage and relative to a seal actuating sleeve on the piston by a plurality of spaced projections extending outwardly from the O-ring. An improved method of forming the valve seat of the throttling valve is also disclosed, wherein the second passage is deformed to substantially conform to the width and shape of the throttling valve and provide substantially zero clearance between the valve and its valve seat.

17 Claims, 3 Drawing Sheets

FLUID CYLINDER CUSHIONING SYSTEM

This is a division of application Ser. No. 089,869, filed Aug. 27, 1987, now U.S. Pat. No. 4,794,681.

BACKGROUND AND SUMMARY OF THE INVENTION

The present invention relates to a fluid power cylinder cushioning system and, more particularly, to a system for adjusting and accurately controlling the speed of a fluid piston as it approaches the ends of the cylinder.

In fluid power piston cylinders cushioning systems have been provided in the past for cushioning the cylinder against the shock and vibration which might otherwise occur as the piston in the cylinder reaches the end of its stroke adjacent the end closures of the cylinder. These prior cushioning systems have included the use of restrictive check valves for permitting the full flow of fluid to drive the piston in one direction, but restrict the flow of fluid toward the end of the piston stroke in the other direction. Other cushioning systems have also employed flapper seals. Still other systems have employed adjustable fluid bypass valves in combination with circular seals about the piston rod. In these latter mentioned systems, the circular seals are actuated by an actuating mechanism on the piston to seal the fluid passages against the flow of fluid from the space between the piston and the cylinder end closure as the piston moves toward the end, and the discharge of fluid from the space is adjustably throttled through the fluid bypass. When the piston is to be moved in the opposite direction, the seal is unseated to permit a less restrictive flow of fluid to the space between the piston and the cylinder end closure.

Each of these prior cushioning systems suffer shortcomings.

The use of restrictive check valves and flapper seals results in a complex assembly which is relatively expensive and difficult to machine and assemble.

Once sealing and cushioning have been completed, it is important that the restriction to fluid flow in the opposite direction be rapidly and substantially completely eliminated in order to reverse the motion of the piston. In the prior systems incorporating circular seals which are actuated by actuating mechanisms on the piston, the seals are generally somewhat reduced in diameter to permit such rapid elimination of restriction to fluid flow and the unrestricted flow of fluid about the perimeter of the seals to reverse the piston. As a result, the seals are subject to damage and early wear because they can not be maintained in a centered condition with respect to the actuating mechanism on the piston. Because such actuating mechanisms typically move into and out of the seal, they tend to damage the seal during operation if the seal is not centered.

Another difficulty in the last mentioned cushioning systems which also employ needle throttling valves in a bypass, is the inability to accurately machine the valves and their valve seats to the extremely small clearances necessary to achieve a high degree of adjustability. This is particularly true in small power cylinders where the throttling valve needles have to be machined to tolerances of 5-ten thousandths of an inch or less to achieve quality cushioning adjustment, i.e. machined essentially to watchmaker fits.

A fluid power cylinder cushioning system incorporating the principles of the present invention overcomes the aforementioned shortcomings. In cushioning systems incorporating the principles of the present invention, a seal is provided which is capable of rapid actuation to both seal and unseal the fluid flow passages, which is inexpensive and easy to assemble, which rapidly permits the substantially unrestricted flow of fluid when needed, and which may be maintained in a centered condition at all times with respect to the actuating mechanism on the piston, thus substantially reducing damage and wear to the seal. Also in a cushioning system incorporating the principles of the present invention, a method has been discovered in which the tolerances and clearances of the throttling valve and its valve seat may be easily and inexpensively formed with a substantially zero clearance, thus permitting a highly precise and readily adjustable throttling range over which the cushioning system may operate.

In one principal aspect of the present invention, a cushioning system for a fluid power cylinder comprises a first passage in an end cap closure which communicates with the space between the end cap closure and the piston for the flow of fluid to and from the space, and a second passage communicating with the space for the flow of fluid from the space. Throttling means throttles the fluid which flows from the space through the second passage. A resilient seal in the first passage has an opening therein and a plurality of projections spaced from each other and extending in a direction opposite the opening. The projections permit the flow of fluid past the seal and center the seal in the first passage. Seal actuating means on the piston actuates the seal when in the opening of the seal and in response to the movement of the piston toward the end cap closure to cause the seal to substantially seal the first passage against the flow of fluid therethrough from the space.

In another principal aspect of the present invention, the aforementioned seal comprises an O-ring, and the projections extend radially outwardly from the O-ring.

In still another principal aspect of the present invention, the aforementioned seal actuating means extends from the piston in a direction substantially parallel to the direction of movement of the piston and is positioned to move into and out of the opening in the seal. The projections center the seal and its opening relative to the seal actuating means when the seal actuating means is out of the opening.

In still another principal aspect of the present invention, the aforementioned seal actuating means actuates the seal upon entry into the opening to substantially seal the first passage as the piston moves toward the end cap closure, and permits deactivation of the seal to allow substantially unrestricted flow of fluid past the seal to move the piston away from the end cap closure.

In still another principal aspect of the present invention, the piston rod of the piston extends through the opening in the seal, and the seal actuating means comprises an enlargement on the piston rod.

In still another principal aspect of the present invention, retaining means retains the seal in the first passage. The retaining means has an opening overlying the opening in the seal and receives the seal actuating means. The retaining means also includes a plurality of spaced projections extending away from its opening, the space between the projections of the retaining means being greater than the width of the projections on the seal.

In still another principal aspect of the present invention, the aforementioned second passage includes a wall, and the throttling means comprises a valve having a longitudinally extending portion which is moveable from a first position to seal the second passage by engaging the passage wall to any one of a plurality of second positions relative to the passage wall to selectively adjust the flow of fluid through the second passage. The spacing between the longitudinally extending portion of the valve and the passage wall is of substantially zero clearance when the valve is in the first position.

In still another principal aspect of the present invention, a method of forming a valve seat of substantially zero clearance with the valve comprises forming a passage having a first width in a material of a given hardness, deforming at least a portion of the passage to decrease the width of the passage at said portion, and inserting a valve having a given shape and width and a hardness greater than the given hardness into said portion of the passage to form the decreased width portion of the passage to conform substantially identically to the given shape and width of the valve, whereby the clearance between the valve and the portion of the passage formed by the valve is substantially zero.

In still another principal aspect of the present invention, the aforementioned method includes forming a second passage having a width greater than and extending from the first passage, and the transition between the first and second passages is defined by a shoulder. The shoulder is deformed to deform the first mentioned passage portion to decrease its width.

In still another principal aspect of the present invention, the aforementioned methods include forming the first mentioned passage adjacent its transition to decrease the width of the first passage with a punch, removing the punch, and inserting the valve into the decreased width portion of the first passage to further deform the decreased width portion to conform substantially identically to the given shape and width of the valve.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENTS

Figure 1:
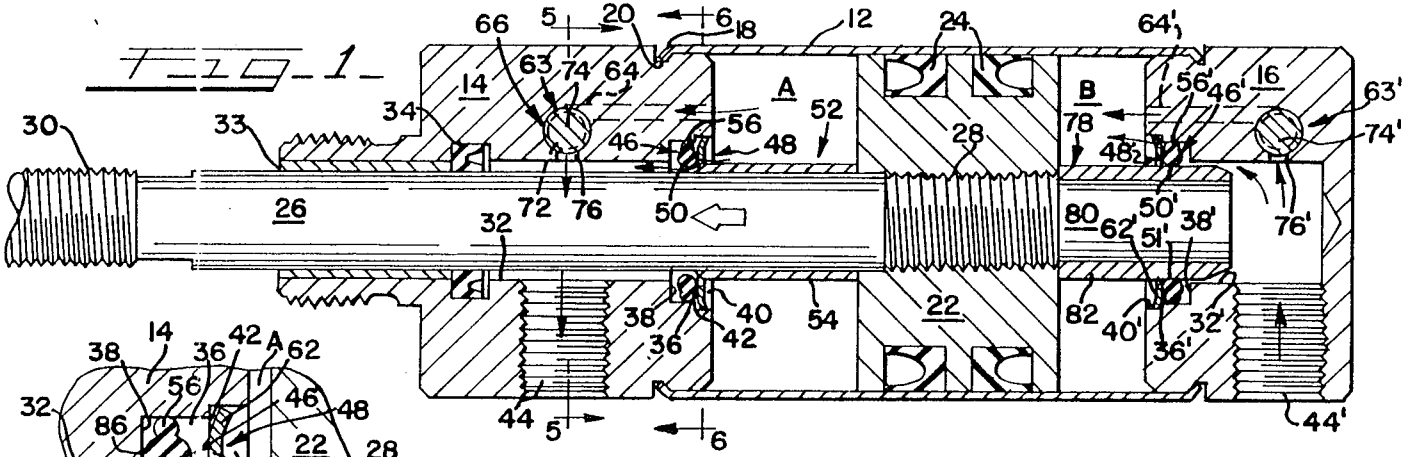
FIG. 1 is a cross sectioned elevational view of a fluid power cylinder incorporating a preferred embodiment of cushioning system of the present invention, and in which the piston of the power cylinder has begun its movement to the left as viewed in FIG. 1.

A fluid power cylinder incorporating a preferred embodiment of cushioning system of the present invention is shown in FIGS. 1–4. The cylinder comprises a generally cylindrical casing body 12, which is closed at both ends by a pair of spaced end cap closures 14 and 16. The casing 12 is fixed to the end cap closures 14 and 16 by any one of a number of known methods, such as by press fitting the annular ends 18 of the casing 12 into annular recesses 20 in the end cap closures.

Figure 2A:
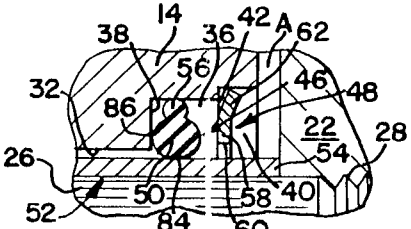
FIG. 2A is a broken, enlarged view of the cushioning seal, as viewed substantially within circle 2A of FIG. 2, and showing the seal actuated to its sealing condition.
Figure 2:
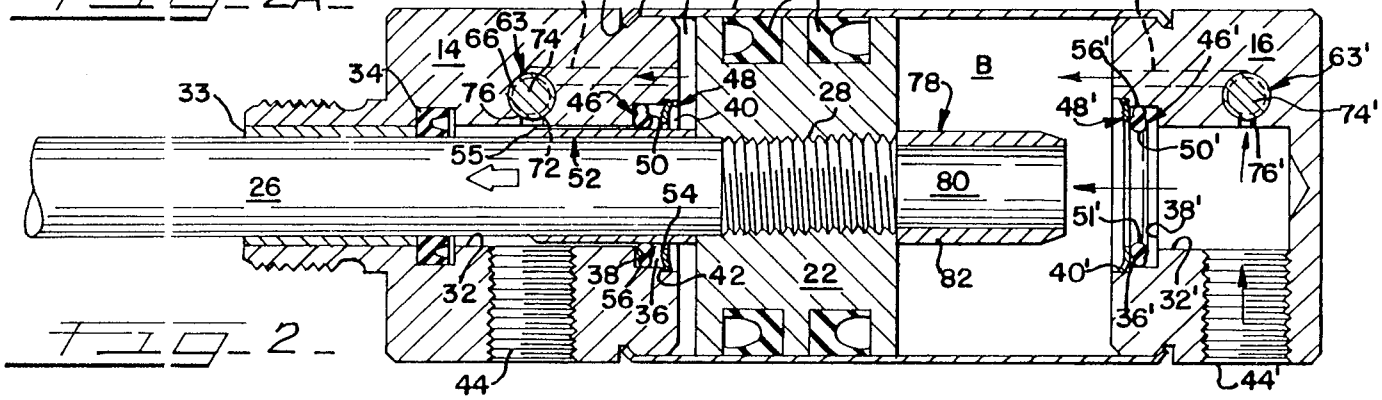
FIG. 2 is a cross sectioned elevational view of the fluid power cylinder substantially as shown in FIG. 1 as the piston has further moved to the left as viewed in FIG. 2, and in which the cushioning system at the left end of the cylinder has been actuated.
Figure 3:
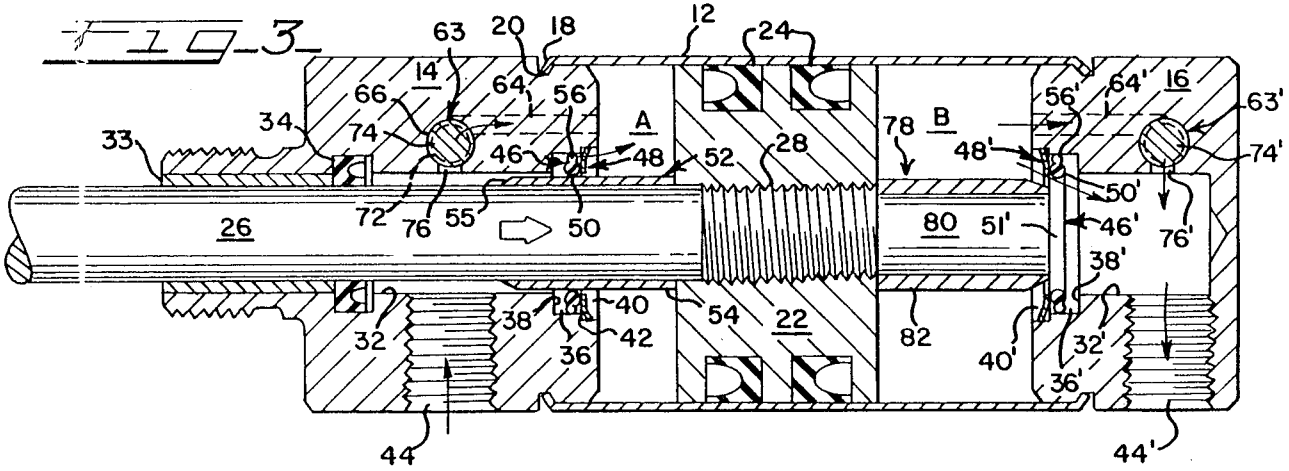
FIG. 3 is a cross sectional elevational view of the fluid power cylinder substantially as shown in FIG. 2, but in which the piston has commenced its movement to the right as viewed in FIG. 3.
Figure 4:
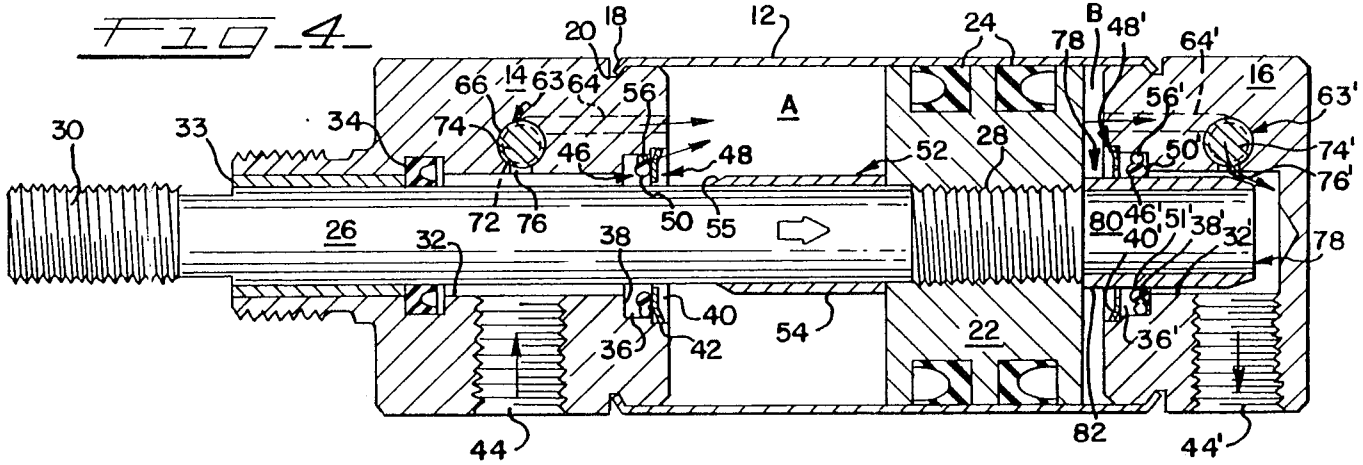
FIG. 4 is a cross sectioned elevational view of the fluid power cylinder substantially as shown in FIG. 3, but in which the piston has moved further to the right as viewed in FIG. 4, and the right cushioning system has been activated.
Figure 5:
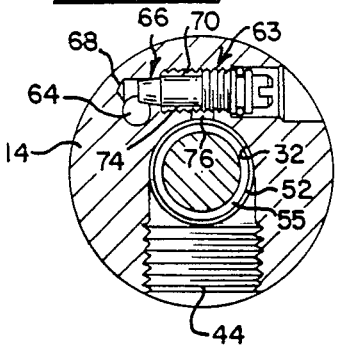
FIG. 5 is a slightly reduced, cross sectioned end elevational view of the fluid power cylinder, as viewed substantially along line 5—5 of FIG. 1, and showing the throttling valve assembly.

A piston 22 is positioned within the power cylinder for reciprocal movement within the casing 12 to the left as viewed in FIGS. 1 and 2, and to the right as viewed in FIGS. 3 and 4. The piston may include one or more annular seals 24 to preclude fluid flow past the piston 22 between the spaces A and B in the cylinder. A piston rod 26 is fixedly attached to the piston 22, such as by threads 28. The end of the piston rod 26 opposite the piston and on the exterior of the power cylinder may also be threaded at 30 or include another appropriate fitting to receive the work piece which is to be operated by the power cylinder.

The piston rod 26 extends through a passage 32 through the end cap closure 14. The passage 32 is preferably somewhat larger in diameter than the piston rod 26 and the piston rod is centered in the passage 32 by a bushing or rod bearing 33. An annular seal 34 precludes leakage of the fluid in the passage 32 through the left side of the power cylinder as viewed in FIGS. 1–4.

Figure 7:
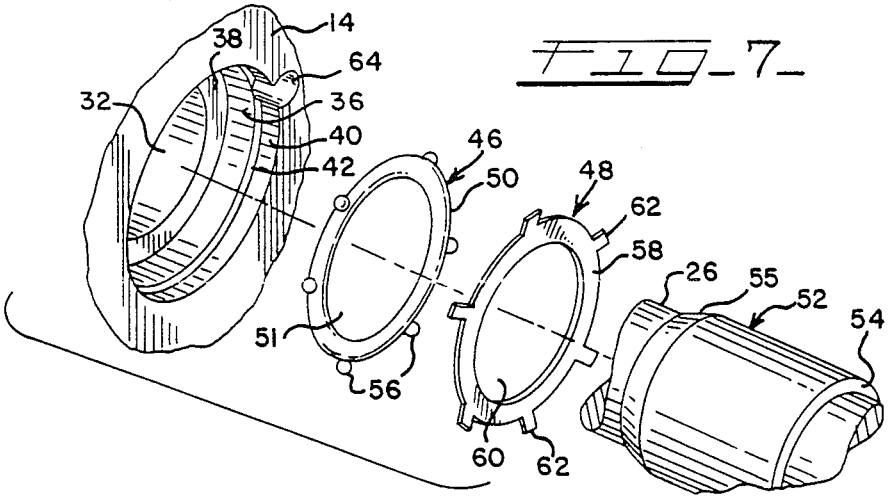
FIG. 7 is an exploded enlarged perspective view of the left portion of the fluid power cylinder substantially as shown in FIG. 1, and showing a broken portion of the end cap closure, the seal, the retainer, and the actuating mechanism of a preferred embodiment of the present invention.

The passage 32 includes an enlarged chamber 36 adjacent space A and a shoulder 38 defines the transition between the passage 32 and the chamber 36, as best viewed in FIGS. 2A and 7. The chamber 36 is further slightly enlarged closer to space A into a chamber 40. The transition between chambers 36 and 40 is also defined by an annular shoulder 42, again as best viewed in FIGS. 2A and 7. The end cap closure 14 also includes a fluid port 44 for the admission and venting of fluid to and from passage 32 and space A.

One of the principal aspects of the cushioning system of the present invention comprises an O-ring seal 46 which is retained in chamber 36 by a retainer 48 in chamber 40.

The preferred O-ring seal 46 of the present invention comprises the O-ring 50 itself, as best viewed in FIG. 7.

The O-ring 50 includes a central opening 51 which is somewhat smaller in diameter than the diameter of a seal actuating member 52 on the piston 22. The actuating member 52 preferably comprises a sleeve 54 which has a tapered lead 55, and which is fixedly attached to the piston rod 26 by a suitable means, such as by an adhesive or shrink fitting, or it may be machined from the piston material. The external diameter of sleeve 54 which is greater than the internal diameter of the O-ring opening 51 is, however, less than the internal diameter of the passage 32 to permit the flow of fluid between the sleeve 54 and the walls of the passage 32, as will be explained in more detail to follow.

The O-ring seal 46 also includes a plurality of nibs or projections 56 which are an important feature of the present invention. The projections 56 are spaced about the outer perimeter of the O-ring 50 and extend in a direction radially opposite the opening 51 in the O-ring. These projections function to center the O-ring 50 and its opening 51 relative to the actuating sleeve 54 when the sleeve is withdrawn from the opening 51, and also permit the flow of fluid past the O-ring seal 46 when the seal is actuated from its sealing position to permit the unrestricted flow of fluid past the seal as the piston moves away from end cap closure 14. By maintaining the O-ring seal 46 in this centered condition at all times, damage and early wear to the O-ring seal is minimized as the sleeve 54 enters and leaves the seal during operation of the piston. The O-ring seal 46 is preferably formed of a molded, flexible resilient elastomeric material.

Figure 6:
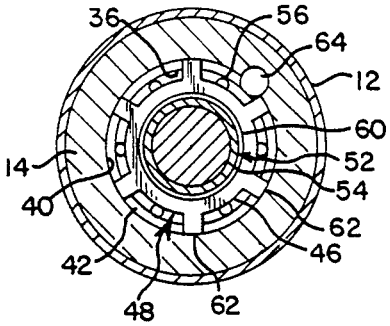
FIG. 6 is a slightly reduced, cross sectioned end elevational view of the fluid power cylinder, as viewed substantially along line 6—6 of FIG. 1.

The retainer 48 is preferably formed of a resilient springy metal, such as steel. As best viewed in FIG. 7, the retainer 48 comprises a ring 58, having an opening 60 in its center. The opening 60 has a diameter which is slightly larger than the diameter of the actuating sleeve 54 to permit unrestricted entry and exit of the sleeve through the opening. A plurality of finger-like projections 62 extend from the ring 58 in spaced relationship to each other and radially from the ring opposite the opening 60. The projections 62 are adapted to be press fitted and held into the chamber 40 against its transition shoulder 42 to retain the O-ring seal 46 in chamber 36. The spacing distance between the projections 62 is substantially greater than the width of the projections or nibs on the O-ring seal 46. Thus, even if the nibs or projections 56 on the O-ring seal 46 become positioned intermediate the projections 62 on the retainer 48, as viewed in FIG. 6, the flow of fluid between the nibs 56 and the outer perimeter of the retainer ring 58 is not restricted.

The preferred embodiment of cushioning system of the present invention also includes a throttling assembly for bypass and throttling of the exit of fluid from space A as the piston 22 moves to the left as viewed in FIG. 2 and approaches the end cap closure 14. The throttling assembly, generally 63, preferably comprises a passage 64 which extends from the inner face of the end cap closure 14 where it communicates with space A to a passage 66 in the end cap closure, as best seen in FIGS. 1–5, 8 and 9.

Passage 66 includes a smaller diameter portion 68 which communicates with passage 64, and an enlarged diameter portion 70, which is preferably threaded at 72 to receive a threaded needle valve 74 which may be threadedly adjusted to adjust the flow of fluid through the throttling passages. The preferred method of forming the passage 66 to ensure substantially zero clearance between the needle valve 74 and the passage will be explained in more detail later. The enlarged diameter portion 70 of passage 66 communicates, in turn, with a passage 76 which vents the passage 66 to the passage 32 and fluid port 44.

The end cap closure 16 at the right end of the fluid power cylinder, as viewed in FIGS. 1–4, and its cushioning system, are substantially identical to the cushioning system and end cap closure thus far described with respect to the left end cap closure 14. Accordingly, like elements have been assigned like reference numerals, except that the elements in the right end cap closure 16 have been designated with a prime "'". Thus, for example, the fluid port in the right end cap closure 16 has been designated 44'.

The only substantive difference between the cushioning assembly at the right end cap closure 16 and that of the left end cap closure 14 in the preferred embodiment shown in the drawings is in the nature of the actuating member 78 at the right end of the cylinder. In the actuating member 78 the piston rod 26 is extended at 80 beyond the right end of the piston 22, as viewed in FIGS. 1–4. This extended portion 80 of the piston rod is of somewhat reduced diameter relative to the diameter of the piston rod 26 to permit its assembly by passage through the threaded portion 28 of the piston 22. However, the actuating sleeve 82 of the actuating member 78 is preferably of the same external diameter as the sleeve 54. Sleeve 82 is also fixedly attached to the piston rod extension 80 by suitable means, such as shrink fitting or adhesively bonding the sleeve 82 to the piston rod extension 80, and the piston rod extension 80 is coterminal with the end of the sleeve 82. It will be understood that the actuating member 78 may be formed in other fashions, such as by the piston rod extension itself.

Although it is believed that the operation of the fluid power cylinder and the cushioning system thus far described will be obvious to one skilled in the art from the foregoing description, a brief description of the operation follows.

In FIG. 1, the piston 22 of the power cylinder is shown moving to the left, but the cushioning system of the present invention has not yet been activated. In the condition shown in FIG. 1, high pressure fluid is being admitted through port 44' and passes through passage 32' into chamber 36' containing the O-ring seal 46'. This high pressure fluid unseats the O-ring seal 46' from its otherwise seated position against shoulder 38'. This unseating is also assisted by the frictional contact between the inner perimeter of the O-ring seal 46' with the actuating sleeve 82, as the latter moves to the left as viewed in FIG. 1. The retainer 48' prevents the O-ring seal 46' from being withdrawn from its chamber 36'.

With the O-ring seal 46' unseated, as shown in FIG. 1, the high pressure fluid flows past the seal and its projections or nibs 56' in a unrestricted manner, and also flows past the spaced projections 62' on the retainer 48' and into space B between the piston 22 and the end cap closure 16 to propel the piston to the left as viewed in FIG. 1. A nominal amount of high pressure fluid, which is essentially inconsequential to operation, will also flow through the passage 76', the needle valve 74' and the passage 64' as shown by the arrows in FIG. 1.

Movement of the piston 22 to the left as viewed in FIG. 1 will not be impaired by the fluid trapped in space A, because that fluid will be freely vented past the projections 62 on the retainer 48 and through the opening 60 in the ring, the opening 51 on the O-ring seal 46 around the piston rod 26, through the chamber 36, the passage 32 and the port 44. Likewise, a nominal inconsequential amount of fluid will also be vented from space A through passages 64, passage 66 and its needle valve 74, passage 76, and passage 32 through the port 44.

As the piston 22 moves closer to the end cap closure 14, as viewed in FIG. 2, the tapered lead 55 of the actuating sleeve 54 will engage the inner perimeter of the opening 51 in the O-ring seal 46. Because the O-ring seal 46 has been accurately centered by projections 56 prior to this engagement, the engagement by the activating sleeve 54 will be true with the seal opening 51, and damage or early wear to the O-ring seal 46 will be minimized.

As the actuating sleeve 54 engages the inner perimeter of the O-ring seal 46 which is slightly smaller than the outer diameter of the sleeve 54, the sleeve will slightly compress the O-ring seal 46 outwardly and frictionally carry the O-ring seal against the shoulder 38 of chamber 36, as shown in FIG. 2 and enlarged FIG. 2A. This movement of the O-ring seal 46 is also assisted by the pressure of the fluid which is being vented from space A.

When the O-ring seal 46 and its O-ring 50 engage shoulder 38 of chamber 36, an annular seal point 84 will be formed, as best viewed in FIG. 2A, between the inner perimeter of the O-ring 50 and the exterior of the actuating sleeve 54, and an annular seal point 86 will also be formed between the O-ring 50 and shoulder 38. These annular seals now block the venting flow of fluid from space A through passage 32.

The only venting from space A which now occurs is the throttled bypass venting through passage 64, passage 66 and its needle valve 74, passages 76 and 32, and the port 44. This throttled venting may be accurately adjusted by adjustment of the needle valve 74 to cushion the approach of piston 22 as it reaches the end closure cap 14.

When it is desired to move the piston in the opposite direction, i.e. to the right as viewed in FIG. 3, high pressure fluid is admitted through the port 44 to the space A, and the fluid in space B is vented through the port 44' as shown by the arrows in FIG. 3.

When high pressure fluid is initially admitted through port 44, it will pass through passage 32 and around sleeve 54, the exterior diameter of the sleeve 54 being slightly less than the diameter of the passage 32. The high pressure fluid will urge the O-ring seal 46 to the right and out of its sealing engagement at seal point 86 with the shoulder 38 of chamber 36. When the O-ring seal 46 is moved to the right by the high pressure fluid and the movement of the sleeve 54, the high pressure fluid will now flow past the now broken seal point 86, between and past the projections 56 on the O-ring seal 46, between the projections 62 on the retainer 48, and into the space A in an unrestricted manner. As before, a nominal and inconsequential amount of high-pressure fluid will also flow through passages 76 and 66, the needle valve 74 and passage 64. This essentially now unrestricted flow of high pressure fluid to the space A will now urge the piston 22 to the right as viewed in FIG. 3.

As the piston continues to move to the right to the position shown in FIG. 4, the actuating sleeve 82 will enter and pass through the opening 60' in the retainer 48', and also pass into and through the opening 51' in the O-ring seal 46'. It will be seen that the centering of the O-ring seal 46' at this end cap closure by the projections or nibs 56' is particularly important because the piston rod to this point has been entirely withdrawn from the O-ring seal, as shown in FIG. 3, unlike the piston rod 26 which is always present in the end cap closure 14.

When the actuating sleeve 82 enters the opening 51' in O-ring seal 46', it will carry it to the right, as viewed in FIG. 4, and will form annular seals between the inner perimeter of the O-ring 50' and the sleeve 82 and against the shoulder 38' of the chamber 36', as previously described in reference to FIG. 2A. These seals now block the venting of fluid from space B through passage 32'. Accordingly, the movement of the piston 22 to the right is now cushioned by the throttled passage of fluid through passage 64', the throttling needle valve 74', and passage 76' to passage 32' and the vent 44'.

An important feature of the cushioning system of the present invention is the method by which the seat for the throttling valve 74 is formed in passages 68 and 70. Particularly in fluid power cylinders which are small, the throttling valve 74 will be quite tiny. However, it is important that the clearances or tolerances between the needle valve and its valve seat be extremely small, and if possible, zero. However, the machining of these very small tolerances or clearances in these very small passages becomes extremely difficult, because the tolerances permissible to result in quality and responsive adjustment may be on the order of watchmaker tolerances, i.e. 5-ten thousandths of an inch or less.

Figure 8:
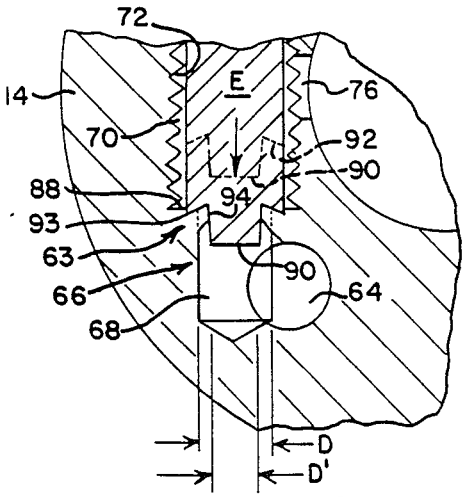
FIGS. 8 & 9 are partially broken, enlarged views of the throttling passages showing a preferred embodiment of method of the present invention for forming the throttling valve seat of the cushioning system of the present invention.

It has been discovered in the present invention that essentially zero clearances may be easily and inexpensively attained in accordance with the method of the invention for forming the valve seat for the needle valve 74. The method of the invention is depicted in FIGS. 8 and 9.

In the preferred method of the present invention, the passages 68 and 70 are of differing dimensions, the passage 68 being of somewhat smaller diameter than the passage 70 so as to define a shoulder 88 at the transition of the passages. In order to form the valve seat for the needle valve, an element E which is formed of a substantially harder material than the material from which the end cap closure 14 is formed is inserted into passage 70. The element E, as viewed in FIG. 8, preferably has a slightly tapered nose 90 and has a cutback face 92 to form a sharp peripheral annular edge 93 for engagement with the shoulder 88. When element E is impacted, as by a punch press, it will deform the shoulder 88, as viewed in FIG. 8, and force a portion of the softer wall material of passage 68 adjacent the shoulder to deform inwardly at 94 against the nose 90 of element E.

Figure 9:
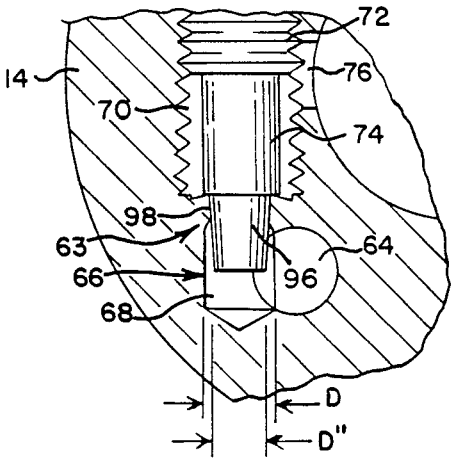

Element E may itself be the needle valve 74 which as shown in FIG. 9 and its tapered nose 96. In this case, punching is eliminated and the needle valve 74 is merely threaded into place. If element E is the needle valve 74, the deformed portion 94 will itself form the valve seat against which the needle valve nose 94 longitudinally bears. It will be seen that by such method of deformation, the deformed portion 94 will result in a decrease in the width of the passage 68 and will form the valve seat in a single operation which is substantially identical to the shape and width of the needle valve nose 96, and will result in a substantially zero clearance with the needle valve nose.

Element E may also comprise a punch. In that event the nose 90 of the punch preferably will be of slightly lesser diameter D' than the diameter D'' of the needle valve nose 96. After the initial deformation has been completed with the punch, the punch is removed and the needle valve 74 is threadedly inserted into the passage 70. As it becomes fully inserted, the needle valve nose 96 will again somewhat deform the prior deformed portion 94 of passage 68 to slightly enlarge the diameter of this deformation, but again, to conform substantially identically to the shape and width of the needle valve nose 96, as shown in FIG. 9. Therefore, the diameter D' of the deformed portion 94 after deformation with the punch, will be less than the diameter D of the passage 68, but the final diameter D'' of the valve seat, as shown in FIG. 9, will be somewhat greater than the diameter D'. Such conformation between the valve seat and the needle valve nose 96 again, will result in essentially zero clearance between the needle valve nose 96 and the valve seat 98 formed by this final deformation.

As previously mentioned, the hardness of the element E and needle valve 74 must be greater than the hardness of the walls of passage 68 in the preferred practice of the method of the present invention. The needle valve or element E may be formed of stainless steel. Where a punch is first utilized as element E and the needle valve 74 is later inserted, the punch is preferably of stainless steel and the needle valve may be of brass. Where these materials are utilized for element E and the needle valve 74, the end cap closure 14 and the walls of its passage 68 are preferably formed of aluminum.

By the provision of substantially zero clearance, it will be seen that the needle valve is capable of movement from a first position in which the passage 68 is fully closed by longitudinal engagement of the needle valve nose 96 with the deformed portion of the wall of passage 68 which forms the valve seat 98, to any one of a plurality of second positions relative to the wall of the passage 68 to permit precise and selective adjustment of the flow of fluid through passage 68. The substantially zero clearance of the needle valve and its valve seat permit extension of the degree and range of flow adjustment to several turns greater than the number of turns that could otherwise be achieved at less than zero tolerances.

It will be understood that the embodiments of the present invention which have been described are merely illustrative of an application of the principles of the present invention. Numerous modifications may be made by those skilled in the art without departing from the spirit and scope of the present invention.

We claim:

1. A cushioning system for a fluid power cylinder having a casing, a piston reciprocally movable in the casing, an end cap closure on said casing, and a piston rod attached to said piston and moveable therewith, said cushioning system comprising:

a first passage in said end cap closure communicating with the space between the end cap closure and the piston for the flow of fluid to and from said space;

a second passage communicating with said space for the flow of fluid from said space;

Throttling means for throttling the fluid which flows from said space through said passage;

a resilient seal in said first passage, said seal having an opening therein and being substantially symmetrical in cross sectional shape, a plurality of resilient projections spaced from each other and extending in a direction opposite said opening, said projections permitting the flow of fluid past said seal and having a length to center said seal in said first passage against movement in said direction; and seal actuating means on said piston for actuating said seal when in the opening of said seal and in response to the movement of said piston toward said end cap closure to cause said seal to substantially seal said first passage against the flow of fluid therethrough from said space.

2. The cushioning system of claim 1, wherein said seal comprises an O-ring and said projections extend radially outwardly from said O-ring.

3. The cushioning system of claim 2, including retaining means for retaining said seal in said first passage, said retaining means having an opening overlying said opening of said seal and receiving said seal actuating means, said retaining means having a plurality of spaced projections extending away from said opening, the space between the projections of said retaining means being greater than the width of said projections on said seal.

4. The cushioning system of claim 2, wherein said projections are formed integrally with said seal.

5. The cushioning system of claim 1, wherein said seal actuating means extends from said piston in a direction substantially parallel to the direction of movement of said piston and is positioned to move into and out of said opening in said seal, said projections centering said seal and its opening relative to said seal actuating means when said actuating means is out of said opening.

6. The cushioning system of claim 5, wherein said seal actuating means actuates said seal upon entry into said opening to substantially seal said first passage as said piston moves toward said end cap closure, and permits deactuation of said seal to allow substantially unrestricted flow of fluid past said seal to move said piston away from said end cap closure.

7. The cushioning system of claim 6, including retaining means for retaining said seal in said first passage, said retaining means having an opening overlying said opening of said seal and receiving said seal actuating means, said retaining means having a plurality of spaced projections extending away from said opening, the space between the projections of said retaining means being greater than the width of said projections on said seal.

8. The cushioning system of claim 5, wherein said piston rod extends through said opening in said seal, and said seal actuating means comprises an enlargement on said piston rod.

9. The cushioning system of claim 8, wherein said actuating means comprise a sleeve on said piston rod.

10. The cushioning system of claim 5, including retaining means for retaining said seal in said first passage, said retaining means having an opening overlying said opening of said seal and receiving said seal actuating means, said retaining means having a plurality of spaced projections extending away from said opening, the space between the projections of said retaining means being greater than the width of said projections on said seal.

11. The cushioning system of claim 1, wherein said second passage includes a wall, and said throttling means comprises a valve having a longitudinally extending portion which is moveable from a first position to seal said second passage by engaging said passage wall to any one of a plurality of second positions relative to said passage wall to selectively adjust the flow of fluid through said second passage, the spacing between said longitudinally extending portion of said valve and said passage wall being of substantially zero clearance when said valve is in said first position.

12. The cushioning system of claim 1, wherein said first passage includes an enlarged chamber which opens from said end cap closure to the space between said end cap closure and the piston, said resilient seal being positioned in said enlarged chamber.

13. The cushioning system of claim 12, including retaining means for retaining said seal in said enlarged chamber, said retaining means having an opening overlying said opening of said seal and receiving said seal actuating means, said retaining means having a plurality of spaced projections extending away from said opening, the space between the projections of said retaining means being greater than the width of said projections on said seal.

14. The cushioning system of claim 1, wherein said projections are formed integrally with said seal.

15. A cushioning system for a fluid power cylinder having a casing, a piston reciprocally movable in the casing, an end cap closure on said casing, and a piston rod attached to said piston and moveable therewith, said cushioning system comprising:

a first passage in said end cap closure communicating with the space between the end cap closure and the piston for the flow of fluid to and from such space;

a second passage communicating with said space for the flow of fluid from said space;

throttling means for throttling the fluid which flows from said space through said second passage;

a resilient seal in said first passage, said seal having an opening therein and a plurality of projections spaced from each other and extending in a direction opposite said opening, said projections permitting the flow of fluid past said seal and centering said seal in said first passage;

seal actuating means on said piston for actuating said seal when in the opening of said seal and in response to the movement of said piston toward said end cap closure to cause said seal to substantially seal said first passage against the flow of fluid therethrough from said space; and retaining means for retaining said seal in said first passage, said retaining means having an opening overlying said opening of said seal and receiving said seal actuating means, said retaining means having a plurality of spaced projections extending away from said opening, the space between the projections of said retaining means being greater than the width of said projections on said seal.

16. The cushioning system of claim 15, wherein said first passage includes an enlarged chamber which opens from said end cap closure to the space between said end cap closure and the piston, said resilient seal being positioned in said enlarged chamber.

17. The cushioning system of claim 15, wherein said projections are formed integrally with said seal.

* * * * *